US007337588B1

(12) United States Patent
Moebus

(10) Patent No.: US 7,337,588 B1
(45) Date of Patent: Mar. 4, 2008

(54) PANEL WITH SLIP-ON PROFILE

(76) Inventor: Maik Moebus, Mühlbacher Str. 1, D-01561 Lampertswalde (DE)

( * ) Notice: Subject to any disclaimer, the term of this patent is extended or adjusted under 35 U.S.C. 154(b) by 0 days.

(21) Appl. No.: 09/890,511

(22) PCT Filed: Feb. 18, 2000

(86) PCT No.: PCT/EP00/01359

§ 371 (c)(1),
(2), (4) Date: Jul. 16, 2003

(87) PCT Pub. No.: WO01/48332

PCT Pub. Date: Jul. 5, 2001

(30) Foreign Application Priority Data

Dec. 27, 1999 (DE) ..... 29922649.2
Feb. 2, 2000 (DE) ..... 20001788.8

(51) Int. Cl.
*E04F 15/04* (2006.01)
*E04F 15/00* (2006.01)

(52) U.S. Cl. ..... 52/592.4; 52/592.1; 52/588.1

(58) Field of Classification Search ..... 52/589.1, 52/591.1, 592.1, 588.1; 2/592.1, 592.4, 588.1
See application file for complete search history.

(56) References Cited

U.S. PATENT DOCUMENTS 5,618,602 A * 4/1997 Nelson ..... 428/60
5,797,237 A * 8/1998 Finkell, Jr. ..... 52/589.1
6,006,486 A * 12/1999 Moriau et al. ..... 52/589.1
6,438,919 B1 * 8/2002 Knauseder ..... 52/586.2
6,490,836 B1 * 12/2002 Moriau et al. ..... 52/589.1
6,497,079 B1 * 12/2002 Steinwender et al. ..... 52/592.4
6,526,719 B2 * 3/2003 Pletzer et al. ..... 52/592.2
6,601,359 B2 * 8/2003 Olofsson ..... 52/588.1
6,672,030 B2 * 1/2004 Schulte ..... 52/747.1
6,675,544 B1 * 1/2004 Ou et al. ..... 52/539
6,682,254 B1 * 1/2004 Olofsson et al. ..... 403/375
6,766,622 B1 * 7/2004 Thiers ..... 52/591.3
6,769,219 B2 * 8/2004 Schwitte et al. ..... 52/592.1

(Continued)

FOREIGN PATENT DOCUMENTS

DE 4242530 A 6/1994

(Continued)

*Primary Examiner*—Robert Canfield
(74) *Attorney, Agent, or Firm*—Schweitzer Cornman Gross & Bondell LLP

(57) ABSTRACT

The invention relates to a panel (1) with connecting means (3, 4, 7, 9) which make a positive connection with a further panel (2) possible. A panel (1) comprises as connecting means laterally a groove (3) formed by two rigid flanks. One of the two rigid flanks (6) is longer than the other one. The longer rigid flank (6) comprises a recess (7). The other panel comprises laterally a tongue (4). The tongue (4) comprises on an under- or top side a lug (9). The lug (9) and the recess (7) are so arranged that the lug (9) is able to engage with the recess (7).

The side of the tongue comprising the lug comprises a slope (12), so that when the panels are in the joined state, as a result of the slope (12) a spacing remains between the slope (12) and the longer rigid flank (6).

The two panels may be connected to one another gluelessly without the exertion of force.

19 Claims, 6 Drawing Sheets

U.S. PATENT DOCUMENTS

| | | | | |
|---|---|---|---|---|
| 6,786,019 | B2 * | 9/2004 | Thiers | 52/589.1 |
| 6,851,241 | B2 * | 2/2005 | Pervan | 52/592.1 |
| 6,862,857 | B2 * | 3/2005 | Tychsen | 52/582.1 |
| 6,874,292 | B2 * | 4/2005 | Moriau et al. | 52/590.2 |
| 6,880,307 | B2 * | 4/2005 | Schwitte et al. | 52/592.1 |
| 6,918,220 | B2 * | 7/2005 | Pervan | 52/578 |
| 6,931,811 | B2 * | 8/2005 | Thiers | 52/592.1 |
| 2002/0046528 | A1 * | 4/2002 | Pervan et al. | 52/588.1 |
| 2004/0168392 | A1 * | 9/2004 | Konzelmann et al. | 52/589.1 |
| 2004/0200175 | A1 * | 10/2004 | Weber | 52/592.1 |
| 2006/0117696 | A1 * | 6/2006 | Pervan | 52/588.1 |

FOREIGN PATENT DOCUMENTS

| | | | | |
|---|---|---|---|---|
| EP | 000698162 | B1 | * | 4/1994 |
| EP | 000855482 | A2 | * | 7/1998 |
| FR | 2785633 | A | | 12/2000 |
| GB | 2256023 | A | | 11/1992 |
| WO | WO 96/27721 | | * | 9/1996 |
| WO | WO 9627719 | A | | 9/1996 |
| WO | WO 97/47834 | | * | 12/1997 |
| WO | WO 9966152 | A | | 12/1999 |

* cited by examiner

PANEL WITH SLIP-ON PROFILE

The invention relates to a slip-on profile for a panel.

A panel, for example known from the printed document EP 090 6994 A1, is a thin plate which is in general elongated and may be connected laterally, namely at the longitudinal and transverse sides, to further panels, for example by means of grooves and tongues. Panels connected to one another in this way are used in particular as floor covering or as wall cladding. The joint which is then formed by the two panels is called a connecting joint below.

A panel is manufactured according to the prior art inter alia by a short-cycle pressing method as follows. On a film-type layer impregnated with resin, which is called "counteracting paper", is placed a support plate. On the latter is placed a further film-type layer impregnated with resin which is provided with a decoration. Such a layer is known under the name "decorating paper". A following corundum- and resin-containing film-type layer is applied to the decorating layer. Said layer is known under the name "overlay". The desired hardness of the surface of a panel is achieved by means of the overlay. The aforementioned layer system is held together at the edge with gripping means and transported into a press. The press consists substantially of two plates arranged parallel to one another, which are heated to about 200° C. The layer system is placed on the lower of the two plates. Thereafter the upper plate is lowered in such a way that the layer system is pressed together. The resins melt by virtue of the heat passed over the plates. Thereafter the upper plate is raised. Grippers with suction cups are brought over the compressed layer system and lowered. The suction cups are set down on the layer system and form a firm suction bond. The layer system is raised by means of the suction cups firmly bonded by suction and transported out of the press. Panels are cut to size out of said layer system with suitable equipment, being conventionally about 1200 to 1300 mm long, five to twelve millimeters thick and about 200 mm wide. Finally, grooves and tongues are milled. Panels are connected to one another by grooves and tongues. They then form floor coverings or wall claddings.

The connected panels are for example assembled as a floor covering, which is known under the name "laminate floor".

To enable glueing to be avoided, there is known from the printed document WO 96/27721 a slip-on profile for a panel, which incorporates first of all in known manner grooves and tongues. In addition to this, each tongue comprises on top and/or underside at least one continuous lug. Each groove is provided with channels in such a way that the lug or lugs engage with the corresponding channel after the bringing together of two panels. A positive connection between two panels is obtained in this way. The use of glue is not necessary in order to assemble panels as a floor or a wall cladding.

Each panel comprises on its two longitudinal and on its two transverse sides a groove or a tongue.

If a panel is connected offset with its longitudinal side to a longitudinal side of an adjacent panel, it may be necessary or useful to be able to displace the latter laterally after the positive connection. Such a lateral displacement is desirable, for example, in order to thereby obtain a smooth lateral edge. It is also desirable for two panels which border one another with their transverse sides to be subsequently brought closer together, in order thereby to obtain a compact surface.

In the prior art, as it is known from printed publications WO 96/27719 or WO 96/27721, the lug-channel-tongue-groove connection extends across the entire longitudinal side of two panels. Strong frictional forces have to be overcome in order to carry out subsequently a relative displacement parallel with a longitudinal side.

In order to prevent such frictional forces, there is provided according to printed publication EP 0 698 162 B1 a clearance (Δ) between a locking nut and a locking surface on a locking element.

According to the patent application WO 97/47834 there is proposed inter alia a glueless connection between two panels, on which said panels a lower, projecting flank of a lateral groove is elastically formed. The geometry, in particular in relation to the position of the projection on the lower flank, is arranged in such a way that the connecting of two panels by a movement which takes place substantially in one plane is made possible.

Disadvantageously a great elasticity of flanks results in the mechanical connection in a horizontal direction being not very stable.

The invention is based on the object of providing panels which may be connected to one another gluelessly and stably.

The object is achieved with the aid of a panel system of the present invention.

A panel comprises at least one laterally milled groove, which is formed by two flanks or legs. The one flank projects beyond the other one, is therefore longer than the other one. Both flanks are rigid, therefore substantially not elastic. A flank is rigid within the meaning of the invention if the latter, in contrast to the teaching according to printed publication WO 97/47834, may not be bent elastically in such a way that a joining by the pushing together of two panels in a plane is possible. At least one recess is provided in the longer flank.

A second panel comprises laterally a tongue which is introduced into the aforementioned groove in order to connect two panels to one another. The tongue comprises at least one projecting lug on its under- or top side, which passes into the aforementioned recess of the flank when the two panels are joined. The lug then extends to the bottom of the recess.

The tongue is so constructed that it exhibits on one side (under- or top side) at least in the area of its open end a spacing from the adjoining flank of the groove when the tongue has been brought into the corresponding groove. Consequently an interval then remains between the respective under- or top side of the tongue and the adjacent flank. Said interval extends at least up to the open end of the tongue, so that the open end does not touch the flank. The tongue is in particular sloped, so that the tongue tapers in said area in a similar way to a tip. The respective under- or top side is the side which borders the flank with the recess. Due to said slope or due to the clearance provided it becomes possible, without major exertion of force, by a rotational movement around the connecting joint of two panels to loosen one panel from a further panel or conversely to connect two panels to one another by the rotational movement. The tongue is therefore moved by a rotational movement into the corresponding groove of an adjacent panel without the flank with the recess having to be strongly bent.

Such a rotational movement is admittedly known from EP 0 855 482 B1. It is not known from the latter, however, to provide an interval by providing, for example, the above-mentioned slope on a tongue, in order thereby to be able to avoid the bending of an adjacent elastic flank.

Due to the geometry according to the invention it is possible to construct the flanks of the lateral groove in a panel in a rigid manner. The positive connection between two panels is then particularly stable.

The lug extends to the bottom of the recess, in order thereby to compensate for the fact that in the area of the slope the tongue no longer, as in the prior art, abuts the flank. A contact surface of this kind is necessary, in fact, in order that the one surface of a panel may not be lowered relative to an adjacent panel surface as the result of a loading.

The lug contacts with a further side a lateral wall of the recess when two panels are joined. The side or wall by means of which an interlock (parallel to the surface of the panel) between two panels is effected is involved here. Said contact is necessary in order that the panels are connected firmly to one another. It may thereby be ensured that the connecting joint between the two panels does not exhibit a gap.

The recess in the flank of the groove is present in particular as a channel which runs parallel with the abutting connecting joint between two panels. A recess may naturally also exhibit other forms. For example, the recess could be an elongated hole with which the corresponding lug of a further panel may engage.

In a development of the invention a gap or clearance between the side of the tongue which exhibits the slope and the projecting flank is provided. The joining of two panels is further facilitated in this way. A gap may be provided, since the lug makes contact with the bottom of the recess and assumes the function of the conventionally provided contact between tongue and groove. The gap or clearance between the tongue and the groove may be restricted to a few hundredths of a millimeter, for example to 3/100 mm as preferred lower limit.

A panel of the present invention therefore comprises such means on the longitudinal and/or transverse sides that two panels may thereby be connected positively to one another. A positive connection within the meaning of the claim is present when two panels assembled on a level surface may by virtue of positive connection be displaced within the plane only parallel with the connecting joint, but not perpendicular to it. It is still possible, however, to rotate a panel about the connecting joint and thus to loosen two panels from one another. During said movement a panel leaves the aforementioned plane. A displacement during which the plane is not left therefore does not take place during such a rotational movement.

The positive connection is unlike the prior art effected with advantage by means of a plurality of lugs. Each lug exhibits a spacing from an adjacent lug. In this way the friction which has to be overcome in order to carry out a displacement of two panels parallel with the connecting joint is reduced.

It is one of the achievements of the inventors to have recognised that it is disadvantageous if, as in the prior art, a lug extends over the entire length of a tongue. Instead of providing such an elongated lug, there is provided according to a development of the invention a plurality of lugs, which extend only over comparatively small distances. On the one hand it is brought about by means of said measure that the desired positive connection is ensured over the whole length of a connecting joint, and on the other that undesirable friction forces are reduced.

It may be left to the skilled man to choose by some tests the spacing between two lugs, the extent of each individual lug and the number of lugs per connecting joint in such a way that the aforementioned desirable effects are optimised.

In an advantageous development of the invention a panel comprises on each longitudinal or transverse side a groove or a tongue. The tongue is introduced into a groove of an adjacent panel in order thereby to connect two panels to one another. A panel comprises further on its longitudinal and transverse sides at least one channel or a plurality of lugs. The channel or lug is accommodated substantially perpendicular to the surface of the panel which forms the floor surface or wall cladding surface. The position of the lugs or channels is so chosen that when the two panels are in the connected state the lugs pass into at least one channel, so that the desired positive connection is produced in this way.

The aforementioned embodiment represents a simple and reliably operating example of the panel system of the present invention. The lug is in particular provided on the longitudinal or transverse side of the panel on which a tongue is accommodated. The longitudinal or transverse side of the panel that comprises a groove then incorporates at least one channel.

Said embodiment represents however only one example. Alternatively the longitudinal or transverse side of the panel that comprises a groove may comprise the lugs. The channel is then provided on the longitudinal or transverse side or sides that comprise the tongues.

In a development of the invention the lugs have along a longitudinal or transverse side a uniform spacing from one another. They are therefore arranged regularly along a longitudinal or transverse side. In this way it is ensured that connecting forces between two panels exert a uniformly distributed effect along the whole of the connecting joint. In a further advantageous development of the invention the spacing between two lugs corresponds roughly to the length of an upper edge of a lug along the longitudinal or transverse side. It has been shown that with said extension or dimensioning of the lugs and spacings on the one hand a reliable positive connection between two panels is ensured and on the other undesirable friction forces are significantly reduced.

In a further development of the invention the transition from an upper edge of a lug to an adjacent upper edge of a lug is circular in shape. Said transition may be produced particularly simply and cheaply by milling.

If two panels are connected to one another via their longitudinal sides and if a third panel is added, the need regularly arises to connect two panels to one another at their (in general short) transverse sides. It is then no longer possible to carry out the aforementioned rotational movement about a connecting joint in order to connect to one another two (in particular short) sides of two panels. In order nevertheless to be able to connect, a groove and tongue connection is provided, which is constructed as follows. The groove possesses legs or flanks of equal length. At least one flank or one leg is elastic. A leg possesses inside the groove a recess. The tongue comprises a lug. If the tongue of the one panel is pushed into the groove of the other panel, the elastic-leg is bent beforehand in such a way that a joining is possible. Finally, the lug engages with the recess. The two panels are then connected to one another in such a way that no gap or clearance remains at the respective connecting joint.

Two panels are in the aforementioned form of execution connected via their longitudinal edges by rotational movement to the longitudinal edge of a third panel. Thereafter the two first-mentioned are fitted over one another by sliding. Finally, the elastic leg of the one panel is suitably bent away (downwards or upwards), so that the adjacent tongue may pass into the groove. Thereafter the lug of the last-mentioned tongue engages with the recess of the elastic groove. The two first-mentioned panels are then also connected to one another by their short edges.

On manufacturing engineering grounds the distance between two lips of the aforementioned groove increases towards the open end. It is then possible to cut a recess in the interior of the groove very much better and more quickly.

The shape of the tongue is then preferably to be adapted to the aforementioned shape of the groove, in order to ensure a good grip. The tongue therefore tapers towards the open end.

In order to separate the aforementioned three panels gently from one another, the two first-mentioned panels are first of all loosened from the third panel by a rotational movement in the opposite direction of rotation. In order to prevent possible damage, the elastic flank is not now bent in such a way that the associated tongue may be drawn out of the groove. Instead the tongue is drawn out laterally by displacement along the connecting joint.

FIGS. 1 to 3 illustrate a first form of execution of long sides of a panel with the rigid flanks.

In FIG. 4 is shown a form of execution of short transverse sides with elastic flanks.

Figure 1:
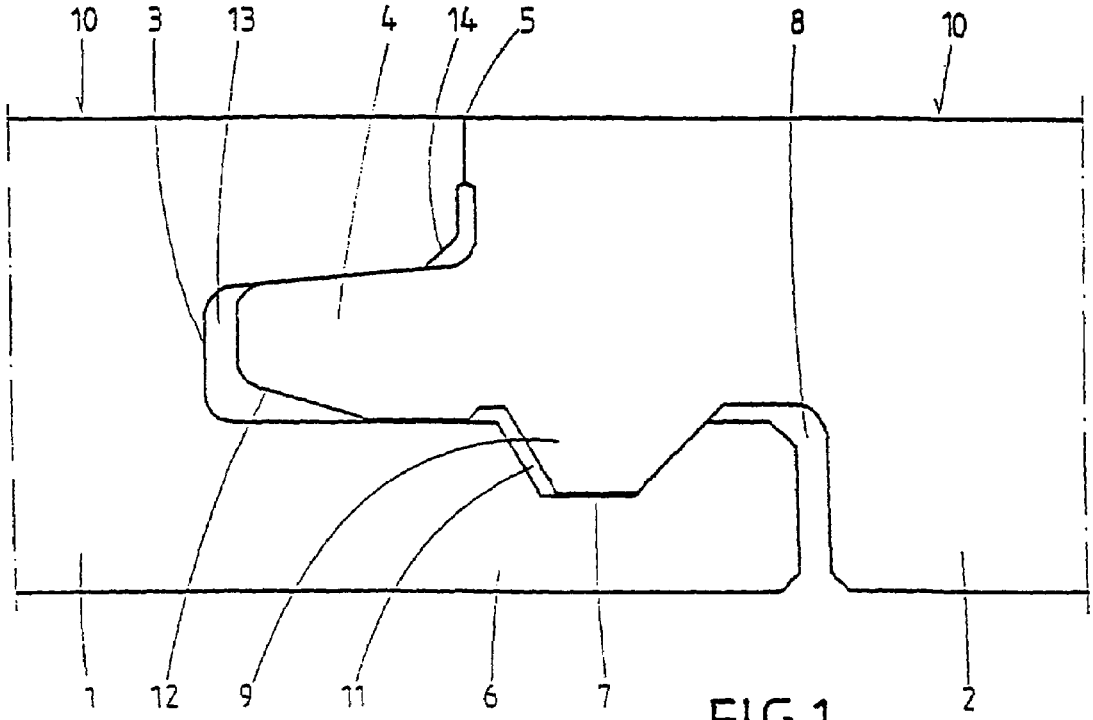

FIG. 1 shows a section through two panels 1 and 2 connected positively to one another in accordance with the invention. Panel 1 comprises on a longitudinal side a groove 3. On a longitudinal side of the panel 2 is provided a tongue 4. The tongue 4 has been twisted into the groove 3 and is therefore located in the groove 3. The connecting joint 5 has served as axis of rotation during the twisting. The connecting joint 5 is a joint which is located between the two panels 1 and 2. The longitudinal side with the channel 3 comprises a projecting lower flank 6. Said lower flank 6 is rigid within the meaning of the invention on the long side, since it is not possible to press the latter downwards sufficiently elastically in order to thereby be able to push the tongue of panel 2 into the groove 3 by a movement in a plane. A channel 7 has been cut as a recess into the lower flank 6 substantially vertically from above. The channel 7 extends across the whole longitudinal side of the panel 1. Panel 2 comprises below the tongue 4 a further recess 8. On the top side of said further recess 8 are accommodated lugs 9. In FIG. 1 it is shown in what manner a lug 9 projects into the channel 7. The position of the lugs 9 is co-ordinated with the channel 7 in such a way that panel 1 abuts closely against the panel 2 on the top side 10 of the panels. No gap therefore remains on the surface at the connecting joint. Unless it is essential for the ensuring of a compact surface 10, a gap 11 is provided between a lug 9 and a channel 7. Problems based on manufacturing tolerances are thus avoided. In addition the handling during the connection of two panels is simplified. The tongue 4 comprises on its underside a slope 12. On said underside the tongue 4 therefore tapers to a point. The slope 12 is provided so as to permit the tongue 4 to be twisted into the groove trouble-free by a rotational movement, without the rigid leg 6 or the lower rigid flank having to bend downwards markedly. The end of the tongue 4 does not project fully into the groove 3, so that a gap 13 remains. Problems which may result from manufacturing inaccuracies are avoided by the provision of said gap. The top side of the groove 3 issues outwards into a slope 14. There therefore also remains at said point a gap between the two panels 1 and 2. By the provision of the gap 14 further space is made available, which is required for the twisting of the tongue 14 into the groove 3. The lug 9 reaches to the bottom of the channel 7.

Figure 2A:
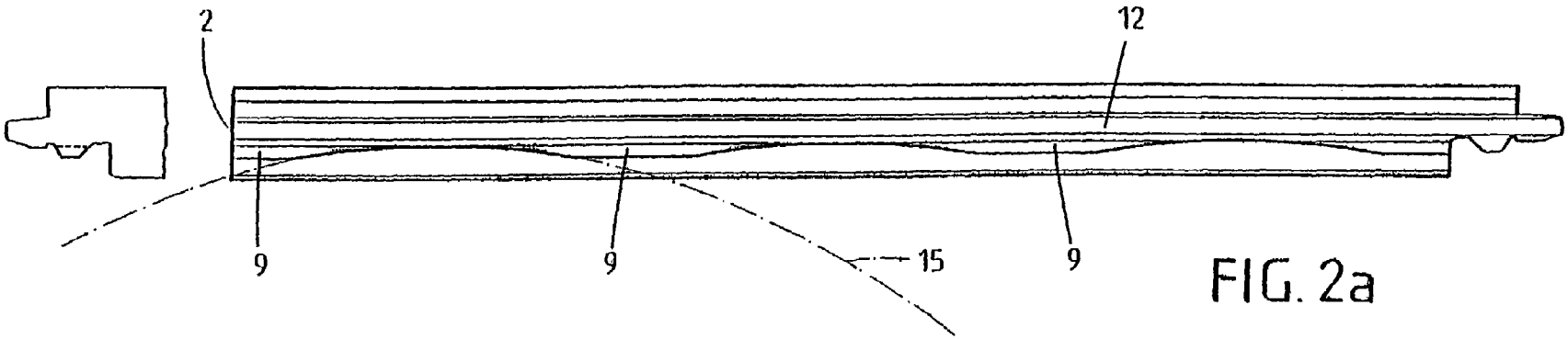
Figure 2B:
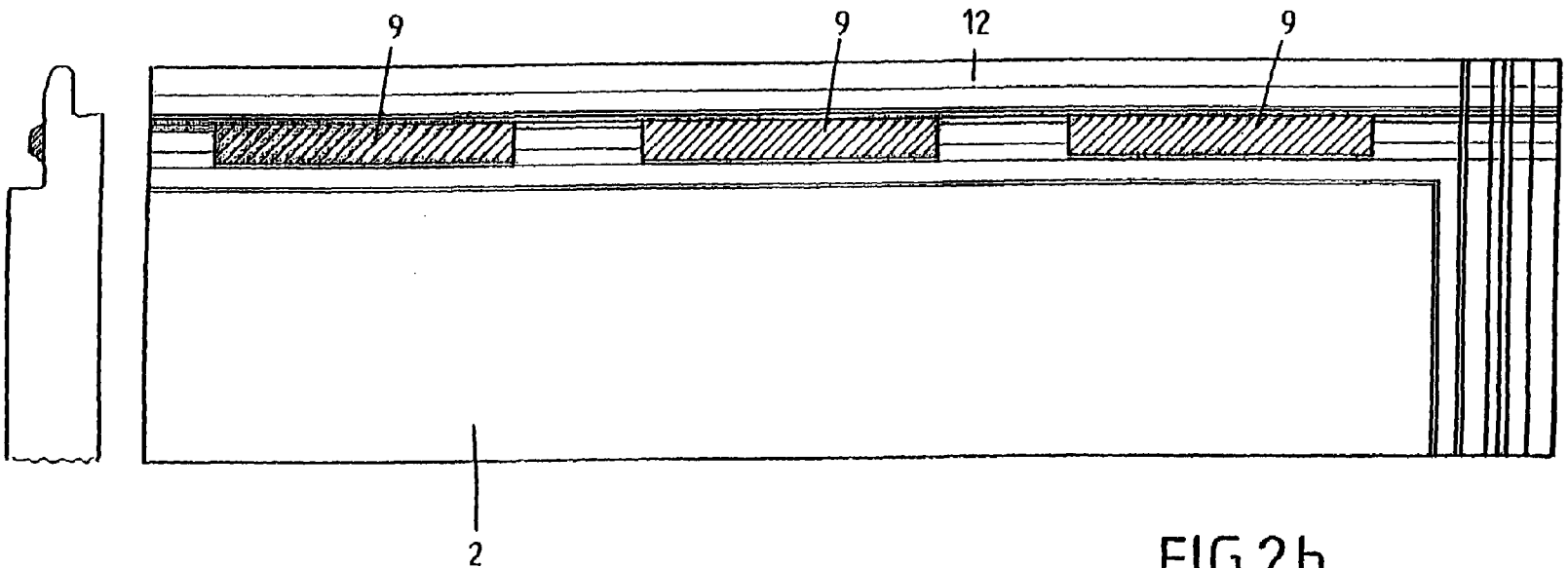

FIG. 2, view a, shows a frontal view onto the longitudinal side of the panel 2 with the tongue 4 and the lugs 9. The transition from a lug top edge of a lug 9 runs to an adjacent lug top edge in the form of a circular arch, as is indicated by the circular line 15. The provision of such a transition permits a particularly simple manufacture of the lugs 9 separate from one another. The lugs 9 are distributed uniformly along the longitudinal side. The distance between two lugs 9 corresponds roughly to the length of a lug 9 along the longitudinal side, as is seen from FIG. 2, view a.

FIG. 2, view b, shows the panel 2 from the underside. The position of the lugs is indicated by hatched areas.

By the provision of intervals between the lugs, friction forces between the lugs 9 and the channel 7 are kept small. Furthermore, there are along the entire longitudinal side, caused by positive closure, connecting forces between two panels. On the one hand the reliable desired connection is thus ensured. On the other a displacement along the connecting joint 5 is possible in many cases, still without major exertion of force.

Figure 3:
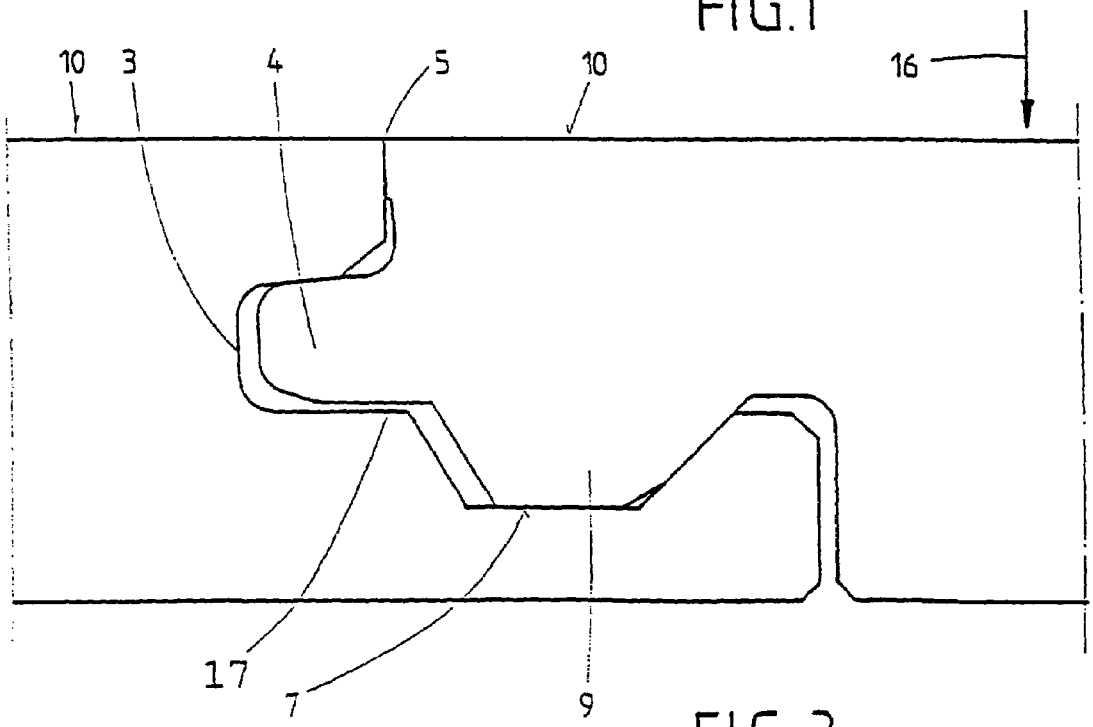

According to FIG. 3 the lug 9 reaches to the bottom of the channel 7 and touches said bottom when the tongue 4 is slipped into the groove 3. In addition a gap 17 is provided between the underside of the tongue 4 and the adjacent leg 6. If the surface 10 is for example loaded in arrow direction at the position 16, the contact between the lug 9 and the channel 7 is responsible substantially for the fact that the joint 5 does not open disadvantageously as a result of lever forces occurring and a gap is formed into which impurities may pass. The contact therefore provides for a stabilising of the desired connection, although at the groove a gap 17 is provided on the underside of the tongue. The gap 17 facilitates the joining of two panels substantially.

Figure 4:
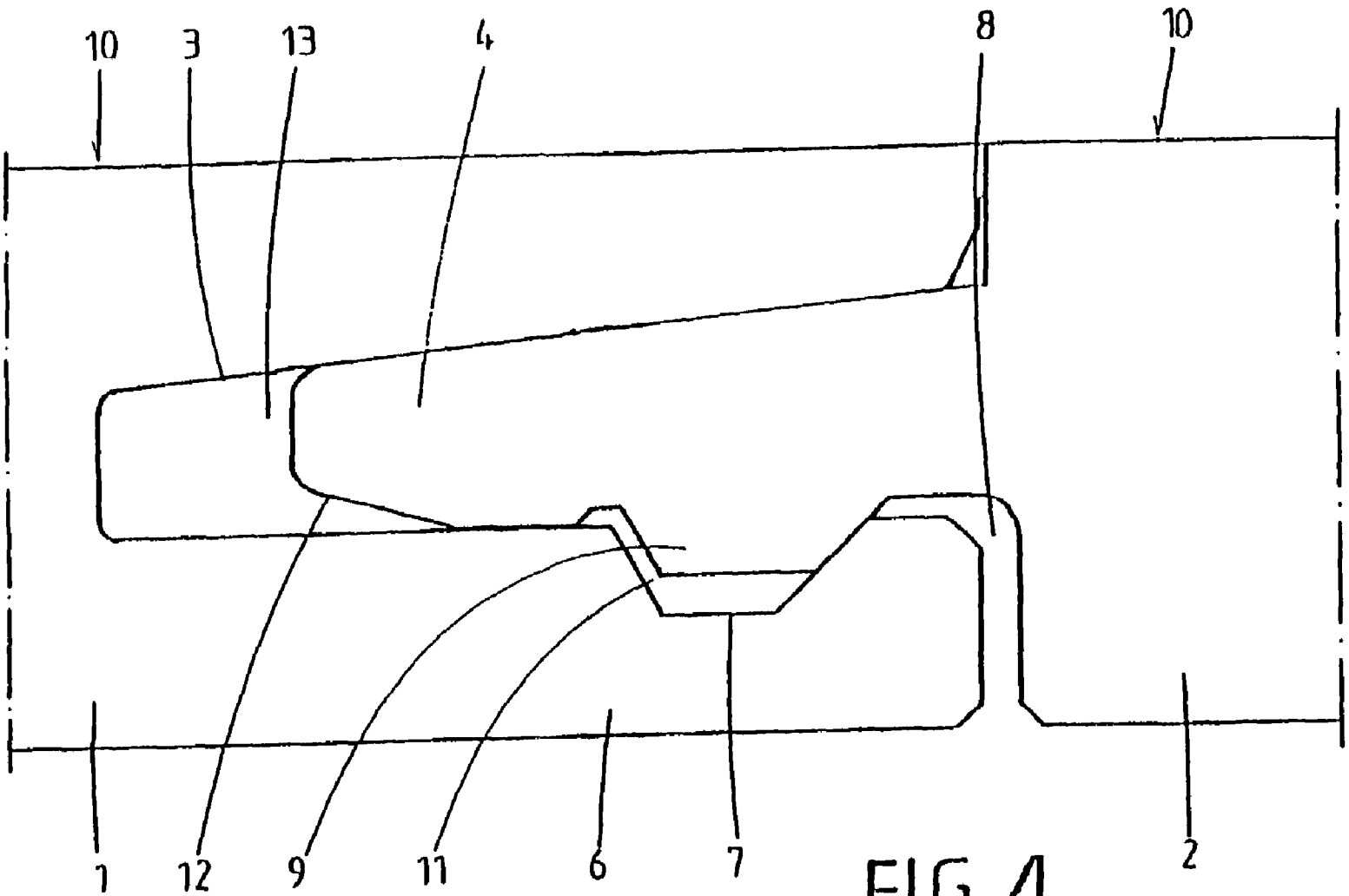

FIG. 4 relates to a short side which shows a leg 6 which is elastic within the meaning of the invention. The elasticity has on the one hand been achieved by a leg 6 which is longer than the leg 6 in the preceding figures. Furthermore, the lug 9 does not reach to the bottom of the recess 7. The leg 6 must therefore be pressed downwards less strongly in order to be able to push the tongue 4 into the groove 3, without a twisting or tilting movement being required.

The desired elasticity may naturally be brought about alternatively or additionally by the choice of suitable materials. It is also possible to reduce the thickness of the leg sufficiently to provide the desired elastic properties.

Preferably the other leg of the groove 3 also comprises a recess. One or more lugs are then provided on the surface of the tongue 4, which pass into the recess on the upper flank and may engage with the latter. The upper flank of the groove 3 is then likewise of elastic construction within the meaning of the invention. The interlocking may be improved in this way.

Further examples of the manner in which a short side with elastic flanks of equal length may be constructed, and the other side with coupling elements corresponding thereto, are found in Austrian patent no. 405 560.

If the sides shown in FIG. 4 of panels 1 and 2 are to be loosened, a bending apart of the legs of the groove 3 is preferably refrained from, as damage could easily be caused by this. Instead, panel 2 is for example pushed into the paper plane of FIG. 4. Channel 7 then functions as a rail. The lug 9 then slides along said rail until the connection between the two panels is loosened.

Figure 5:
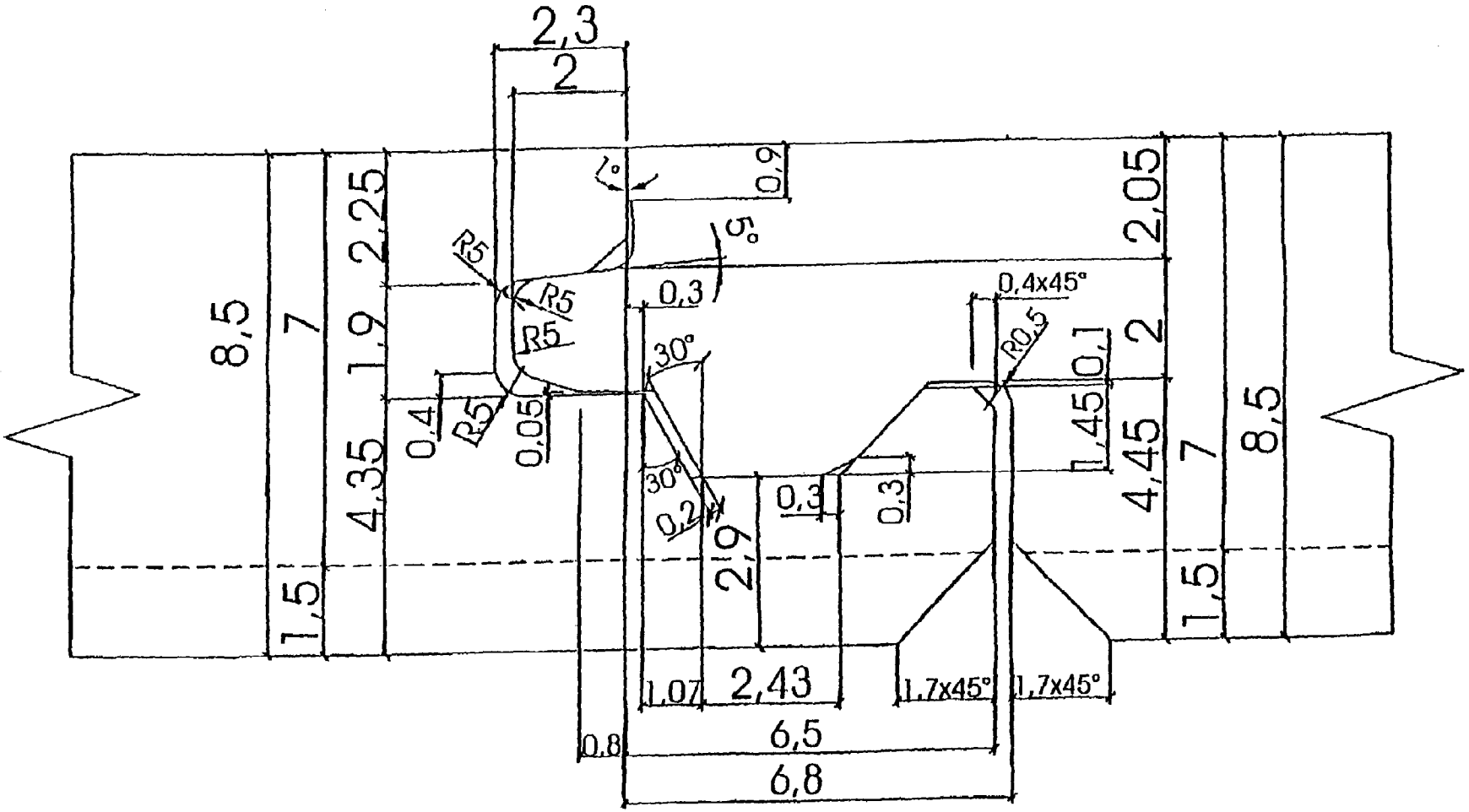
FIG. 5 shows a particularly preferred form of execution with dimensions in millimeters.
Figure 6:
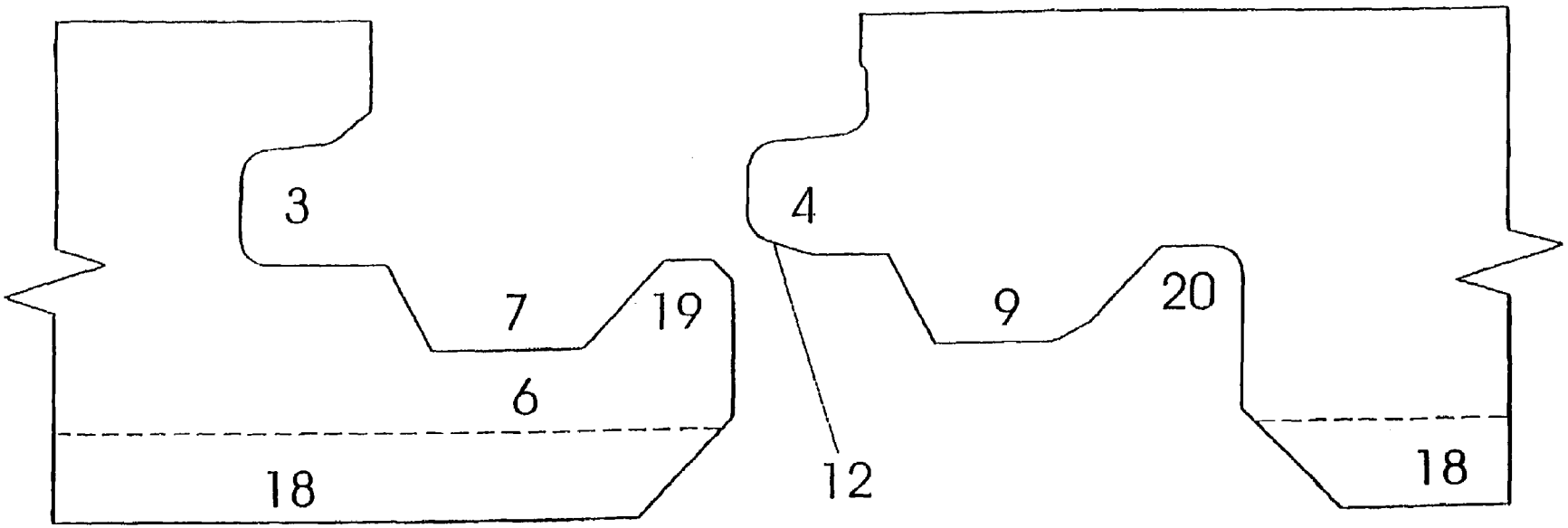
FIG. 6 shows the form of execution according to FIG. 5 with the dimensions omitted.

FIGS. 5 and 6 show the same form of execution. FIG. 5 shows the exact dimensions in millimeters. FIG. 6 shows the form of execution with reference symbols. A layer 18 of a footfall sound-dampening material is affixed to the underside of the panels and connected firmly to the panels, in order thereby to produce a particularly good and reliable dampening.

The lug 9 reaches to the bottom of the recess 7 in order to produce a support, as explained above. Alternatively or additionally the raised area 19 at the open end of the lip 6 may extend up to the end of the recess 20 which is formed by the lug 9. A comparable support is produced in this way.

The dimensions according to FIG. 5 are chosen in such a way that no practical force has to be exerted in order to join two panels by means of a rotational movement about the connecting joint. It is in particular not necessary to bend the lip 6 downwards in order to join two panels.

According to FIG. 5 the lug also comprises on its top side a slight slope to which the top side of the groove 3 is correspondingly adapted. The lug therefore tapers towards the open end, since corresponding slopes are provided both on its top side and on its underside. The slope on the top side extends preferably over a longer distance compared to the underside, in order thereby to make an insertion of the lug into the groove particularly simple, as tests have shown.

Figure 7:
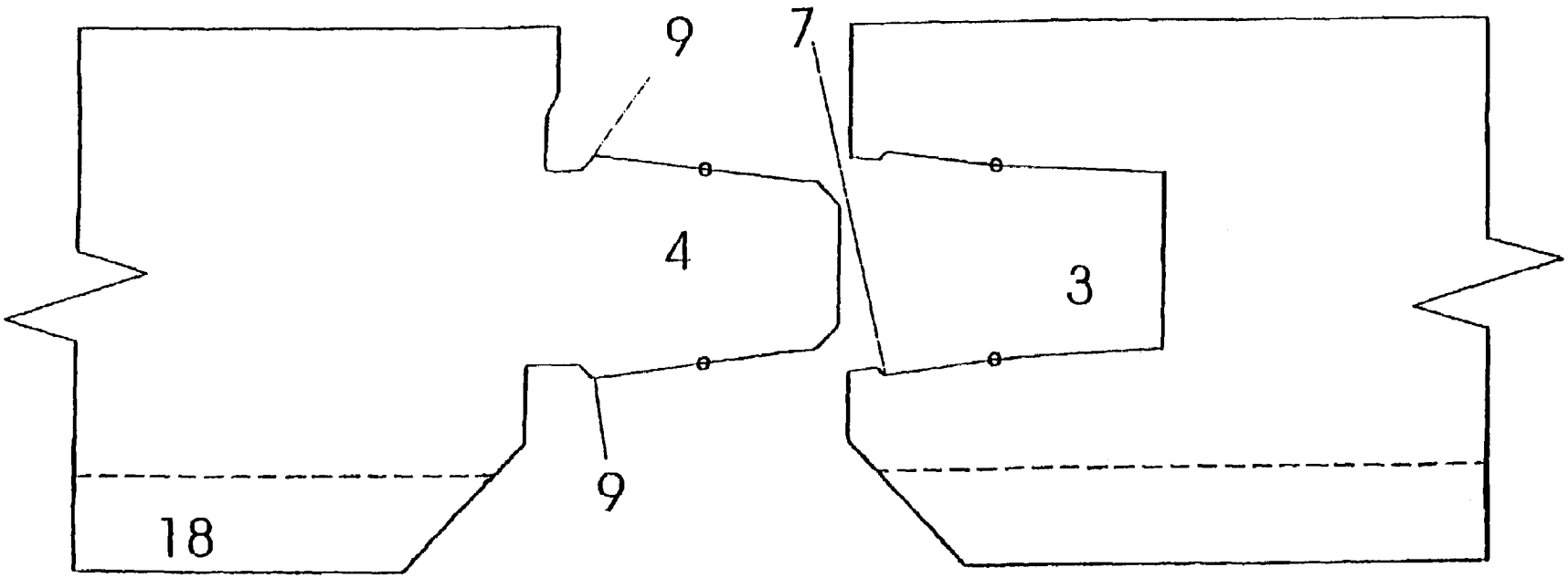
FIG. 7 shows a particularly preferred profile on the transverse sides of a panel.

FIG. 7 shows a particularly preferred form of execution of a transverse side in cross-section. In the main the groove 3 expands towards the open end, to enable the recesses 7 to be cut rapidly and reliably.

The invention claimed is:

1. A panel connecting system comprising at least first and second panels, wherein each panel has at least on one side thereof connecting means (3, 4, 7, 9) which permit a positive connection with the respective other panel, wherein, the first panel (1) comprises as connecting means laterally a groove (3) formed by two flanks, one of the two flanks (6) is longer than the other one, the longer flank (6) comprises a recess (7), the second panel comprises as connecting means laterally a tongue (4), which is shaped to fit into the groove of the first panel, the tongue (4) comprises on an under or top side a plurality of lugs (9), which lugs are arranged in one line parallel to the tongue, each lug exhibiting a space from an adjacent lug, whereby the lugs (9) and the recess (7) are so arranged with respect to each other, that the lugs (9) are able to engage with the recess (7), when the two panels are joined.

2. A panel connecting system according to claim 1, in which the lugs (9) reaches to the bottom of the recess (7) in the engaged state or a raised area (19) at a open end of the longer flank (6) extends to the end of a recess (20) which is formed by the lugs (9) on the underside of the associated panel.

3. A panel connecting system according to claim 2, in which the side of the tongue (4) which comprises the lugs (9) as the result of the provision of a recess does not touch the flank (6) in the interior of the groove (3) when the panels are joined, so that an interval (17) remains.

4. A panel connecting system according to claim 3, in which the lugs (9) make contact with a side wall of the recess (7), through which connection between the two panels (1, 2) is effected.

5. A panel connecting system according to claim 1, in which the recess is present as a channel.

6. A panel connecting system according to claim 1, in which a plurality of lugs (9) is provided on a longitudinal side or on a transverse side of a panel (2), wherein each lug (9) exhibits a spacing from an adjacent lug (9).

7. A panel connecting system according to claim 1, in which the lugs (9) project substantially perpendicular to the surface (10) of said second panel.

8. A panel connecting system according to claim 1, in which tongue (4), groove (3), recess (7) and lugs (9) are so provided that the positive connection is produced by a tongue being twisted into a groove.

9. A panel connecting system according to claim 1, in which tongues (4), grooves (3), recess (7) and lugs (9) are so dimensioned that intervals or gaps (13) remain between a distal end of a tongue (4) and a groove (3) of panels connected to one another, so that a tongue (4) may be twisted into a groove (3).

10. A panel connecting system according to claim 1, in which lugs (9) are distributed uniformly along a longitudinal side or a transverse side.

11. A panel connecting system according to claim 1, in which the distance between two lugs (9) corresponds roughly to the length of a lug along a longitudinal side or transverse side.

12. A panel connecting system according to claim 1, in which the transition from a top edge of a lug (9) to a top edge of an adjacent lug (9) is a circular in shape.

13. A panel connecting system according to claim 1, in which said tongue (4) comprises a slope on its top side, so that the tongue tapers towards a distal end of said tongue.

14. A panel connecting system according to claim 1, in which a groove (3) comprises a slope (14) in an outward direction on its top side, so that in this way a gap remains between the tongue and the groove in the joined state.

15. A panel connecting system according to claim 1, in which on a short transverse side of a panel (1) at least one elastic flank (6) is provided.

16. A panel connecting system according to claim 1, in which the flanks of the groove (3) are substantially of equal length on a short transverse side.

17. A panel connecting system according to claim 1, in which the side of the tongue comprising the lugs comprises a sloped surface, so that when the two panels are in the joined state, there remains, as a result of the sloped surface, an interval between the side of the tongue comprising the lugs and the longer flank, so that a distal end of the tongue does not touch the flank when the two panels are joined.

18. A panel connecting system according to claim 17, in which the tongue (4) is separated from the longer rigid flank (6) from the lugs (9) up to the slope (12) by a gap (17).

19. A method for the loosening of a first and second panels (1, 2), each panel (1) having connecting means (3, 4, 7, 9) which permit a positive connection with a further panel (2), a first panel (1) comprises as connecting means laterally a groove (3) formed by two rigid flanks, one of the two rigid flanks (6) is longer than the other one, the longer rigid flank (6) comprises a recess (7), the other panel comprises laterally a tongue (4), the tongue (4) comprises on an under- or top side a plurality of lugs (9), each lug exhibiting a spacing from an adjacent lug along the length of the tongue, the lugs (9) and the recess (7) are so arranged that the lugs (9) are able to engage with the recess (7); and the side of the tongue comprising the lugs comprises a recess in particular in the form of a slope (12), so that when the two panels are in the joined state, there remains, as a result of the recess formed in particular by a slope (12), an interval between the side of the tongue (4) comprising the lugs (9) and the longer rigid flank (6), so that the open end of the tongue does not touch the rigid flank (6) when the two panels are joined, said panels (1,2) connected positively to one another on the short transverse sides, comprising displacing said first panel (1) along a connecting joint (5) until said first panel (1) is loosened from said second panel (2).

* * * * *